United States Patent [19]

Chadwick

[11] Patent Number: 4,503,779

[45] Date of Patent: Mar. 12, 1985

[54] INTERCONNECTING PASSAGE FOR ARTICULATED VEHICLE

[75] Inventor: Dennis P. Chadwick, Napanee, Canada

[73] Assignee: Urban Transportation Development Corporation Ltd., Toronto, Canada

[21] Appl. No.: 352,232

[22] Filed: Feb. 25, 1982

[30] Foreign Application Priority Data

Feb. 26, 1981 [CA] Canada ..... 371834

[51] Int. Cl.[3] ..... B61D 17/14; B61D 17/20; B61F 3/12

[52] U.S. Cl. ..... 105/4 R; 105/17; 105/18; 280/403

[58] Field of Search ..... 105/3, 4 R, 8 R, 15, 105/16, 17, 18; 280/403, 432, 461 R, 497; 296/1 R

[56] References Cited

U.S. PATENT DOCUMENTS

| | | | |
|---|---|---|---|
| 441,178 | 11/1890 | Libbey | 105/3 |
| 1,499,510 | 7/1924 | Elliott | 105/3 |
| 1,754,111 | 4/1930 | Latshaw | 105/4 R |
| 2,109,275 | 2/1938 | Pflager | 105/8 R X |
| 2,184,298 | 12/1939 | Groff | 105/4 R |
| 2,216,547 | 10/1940 | Christianson | 105/3 |
| 2,268,318 | 12/1941 | Urbinati | 105/4 R |
| 3,030,897 | 4/1962 | Barry | 105/8 R |
| 3,610,166 | 10/1971 | Ellzey | 105/3 X |
| 3,884,155 | 5/1975 | Maroshick | 105/4 R |
| 3,922,971 | 12/1978 | Maroshick | 105/4 R |

*Primary Examiner*—Howard Beltran

*Attorney, Agent, or Firm*—Norbert P. Holler; Charles A. Blank

[57] ABSTRACT

A tunnel structure for interconnecting passenger compartments on an articulated vehicle includes pairs of cylindrical walls which overlap during steering movement of the vehicle. To seal between the cylindrical walls, a pair of inner walls is provided which include hinged flaps lying against the cylindrical wall. The flaps are hinged on an inclined axis to reduce clearance between the cylindrical walls and the side walls upon the vehicle negotiating vertical curves.

11 Claims, 14 Drawing Figures

14

12

INTERCONNECTING PASSAGE FOR ARTICULATED VEHICLE

The present invention relates to articulated vehicles and more particularly to articulated passenger carrying vehicles.

It is well known to articulate a vehicle to enable it to accommodate sharper curves in service. The articulation between the two chassis portions of the vehicle will usually accommodate both movement about a horizontal axis to accommodate changes in terrain and movement about a verticle axis to accommodate steering motion. With passenger carrying vehicles, it is desirable that the passenger compartments carried by both parts of the vehicle are interconnected to allow movement of passengers from one portion to another. This avoids the need for duplicate crew and ensures that the passengers are evenly distributed throughout the vehicle.

An encloed tunnel is usually provided for interconnecting the two portions of the vehicle but such structures have usually created problems in that they must accommodate movements about both the vertical and horizontal axis whilst retaining an uniform cross section to the tunnel. Further it is important that the structure forming the tunnel does not prevent a safety hazard by exposing passengers within the tunnel to moving structure which could cut or crush a passenger thrown against the side of the tunnel.

Various arrangements have been proposed for forming the tunnel structure, most common being the use of bellows with sliding platforms. This arrangement however is not entirely satisfactory in that it does not provide a rigid structure and is not aesthetically pleasing.

A further proposal has been to form the tunnel structure in two sets of overlaping parts. Thus a generally cylindrical structure is provided to accommodate the steering articulation with the cylindrical structure overlapping as the vehicle negotiates a curve. Mounted within the cylindrical structure is a pair of generally rectangular tunnel members which telescope within one another and provide curved roof lines to accommodate the movement about the horizontal axis. Thus one of the set of parts accommodates movement about the vertical axis and the other set of parts accommodates movement about a horizontal axis. This arrangement however requires a plurality of separate housing which must smoothly slide within the other. Such an arrangement is costly and does not entirely avoid the possibility of entrapment between relatively sliding parts.

According to the present invention therefore there is provided an articulated vehicle comprising a first chassis and a second chassis, each having an outboard end and an inboard end, a coupling assembly interconnecting said inboard ends and including a vertical pivot assembly to accommodate relative movement of said chassis about a vertical axis for steering movement of said vehicle and a horizontal pivot assembly to accommodate relative pivotal movement of said chassis about a transverse horizontal axis for relative vertical movement between said outboard ends, and a tunnel structure interconnecting said chassis, said tunnel structure including a first pair of laterally spaced upstanding partitions mounted on one of said chassis and defining a first passage, a second pair of laterally spaced upstanding partitions mounted on the other of said chassis and defining a second passage, a pair of upstanding side walls located inwardly of said partitions and each extending between said first and second passages to define a continuous passageway from said one chassis to the other, said side walls each including a stationary portion and a movable portion pivotally connected to said stationary portion for movement about an axis inclined to the axis defined by said vertical pivot means, said movable portions each having an edge abutting an adjacent partition, so that upon movement of any partition relative to its associated side wall upon relative movement of one chassis to the other about a horizontal axis, the associated movable portion moves about its respective inclined axis to follow the movement of its associated partition.

An embodiment to the invention will now be described by way of example only with reference to the accompanying drawings in which:

FIG. 1 is a general side view of an articulated street car,

FIG. 2 is a sectional elevation of the central portion of the street car shown in FIG. 1, FIG. 3 is a plan view of FIG. 2, FIG. 4 is a schematic plan view showing the linkage of FIG. 3 in different operating positions of the street cars with FIG. 4*a l showing the linkage with the cars in a straight horizontal position, FIG. 4b* showing the street cars negotiating a horizontal curve and FIG. 4*c* showing the street cars negotiating a vertical curve.

Figure 2:
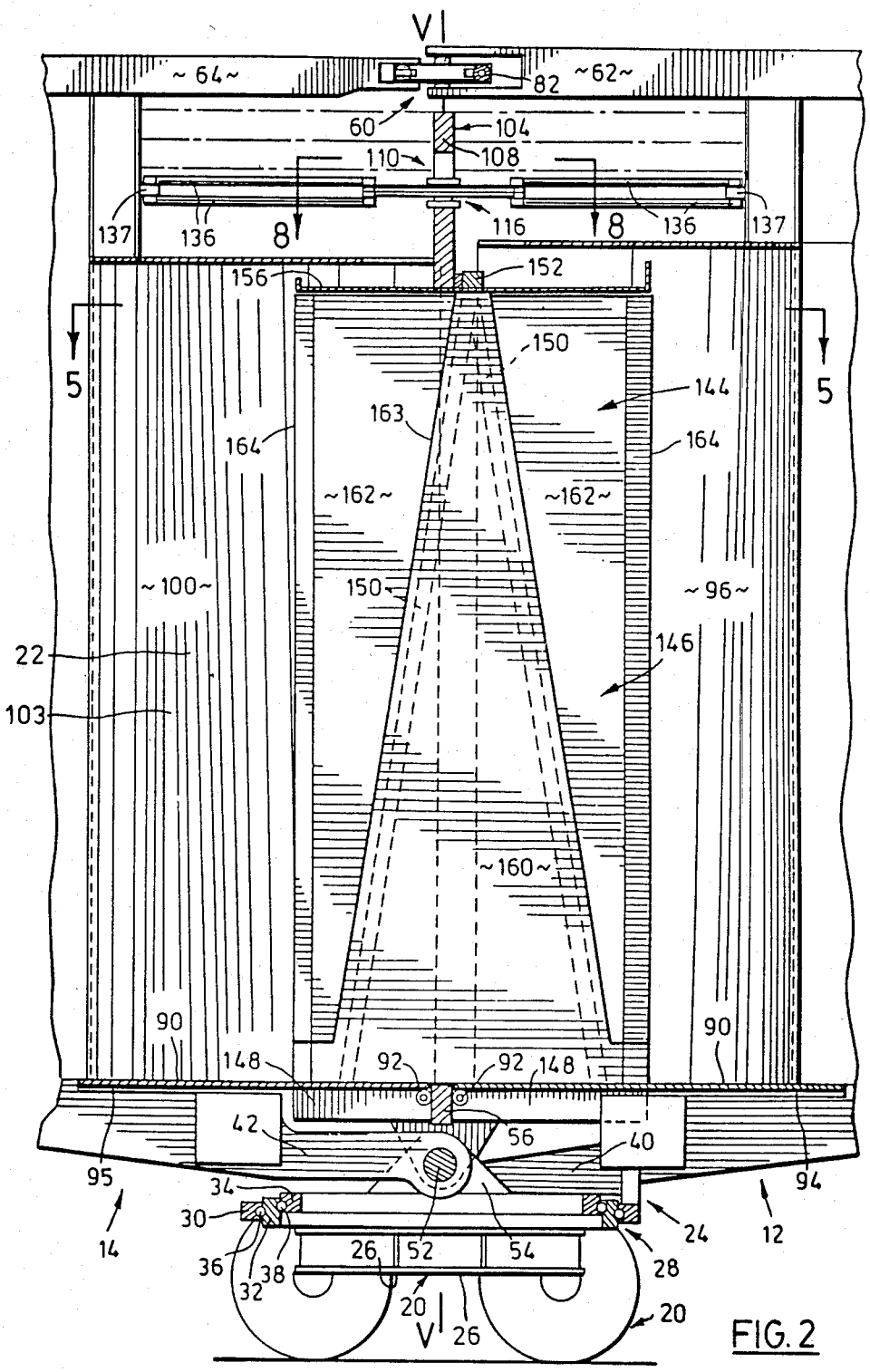
Figure 7C:
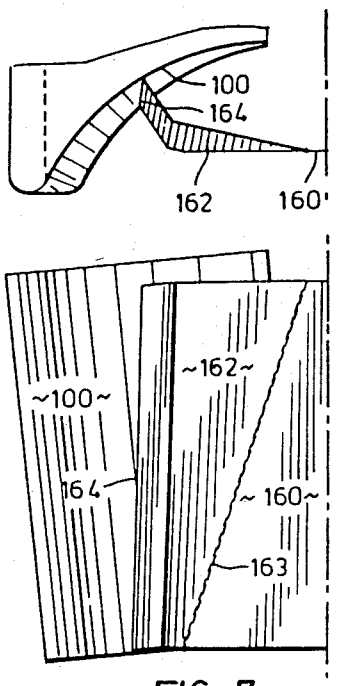
Figure 7B:
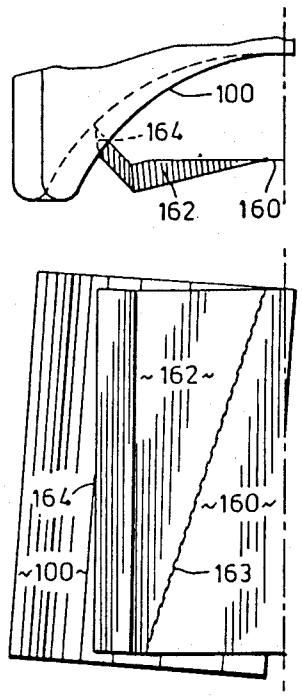
Figure 7A:
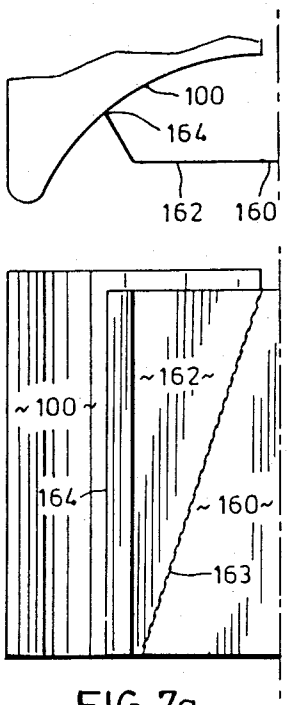
Figure 8:
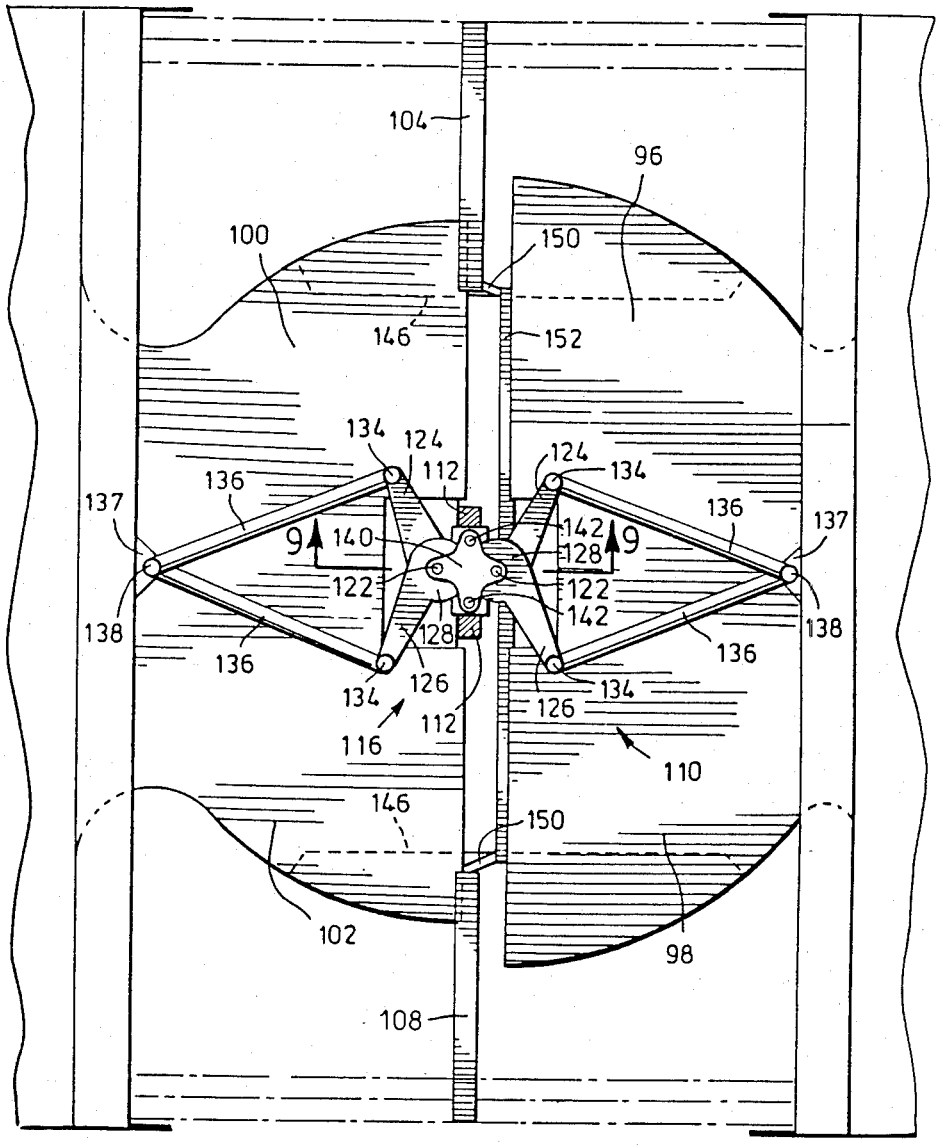

FIG. 7 is a series of diagrammatic representation showing in plan and elevation the operation of portions of the tunnel structure shown in FIG. 2 with FIG. 7*a* showing the street car in a generally horizontal disposition, FIG. 7*b* showing the street car negotiating a concave vertical curve and FIG. 7*c* showing the street car negotiating a convex vertical curve, FIG. 8 is a section on the line 8—8 of FIG. 2.

Figure 9:
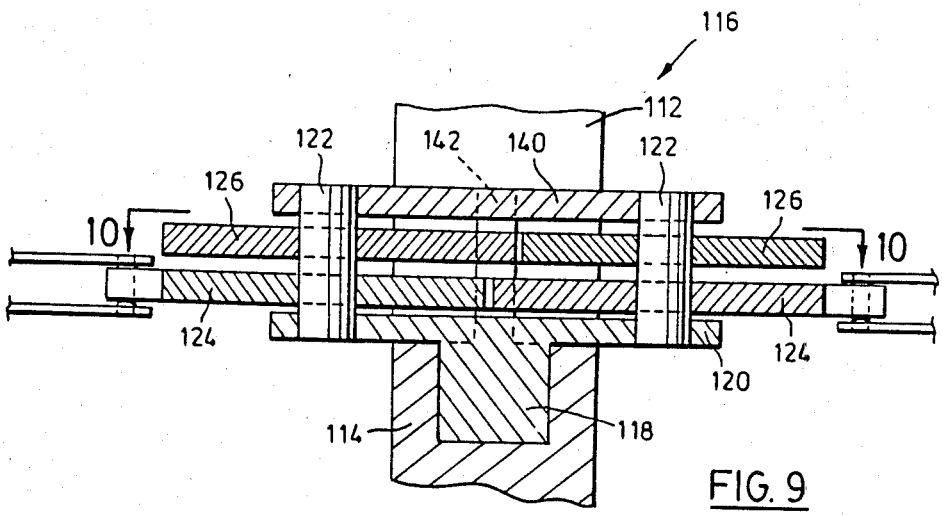

FIG. 9 is a section on the line 9—9 of FIG. 8.

Figure 10:
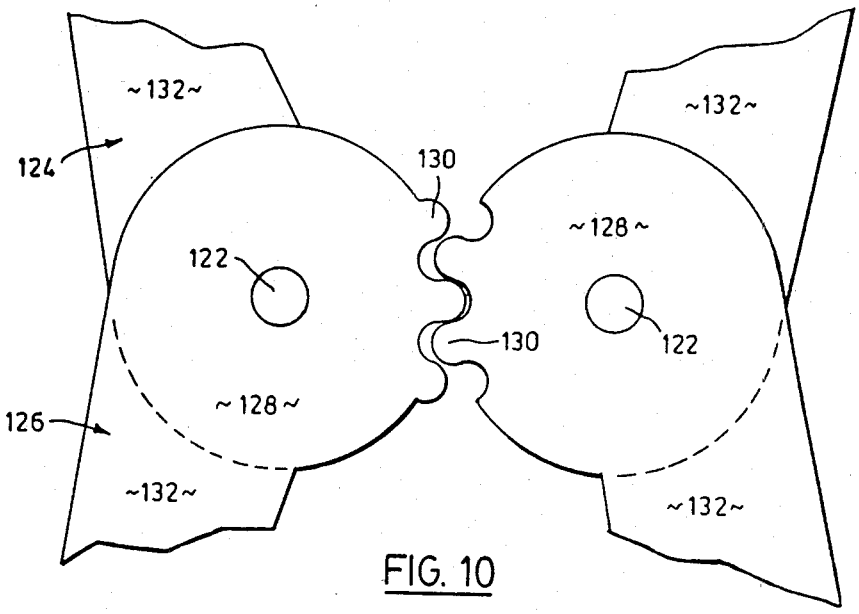

FIG. 10 is view on an enlarged scale on the line 10—10 of FIG. 9.

Figure 1:
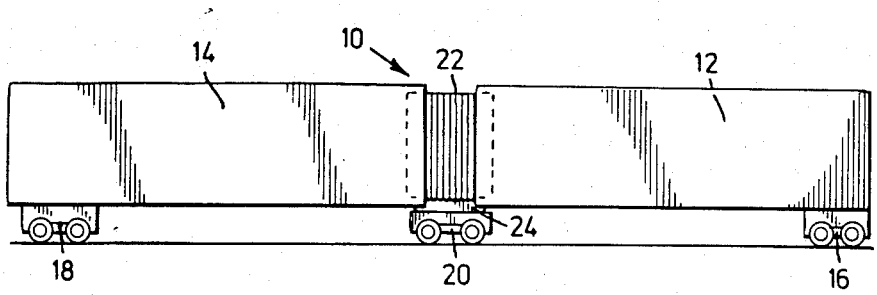

Referring now to the drawings and in particular FIG. 1, an articulated vehicle, in this case a street car, generally designated 10 comprises a leading car 12 and a trailing car 14. The cars 12 and 14 are supported on leading and trailing bogies 16, 18 respectively and by an intermediate bogie 20 positioned between the two cars. The intermediate bogie 20 also supports a tunnel structure generally designated 22 which interconnects the interiors of the two cars 12, 14 to allow movement of passengers between the cars. The cars 12 and 14 are connected to a turntable 24 to accommodate relative movement about a vertical axis designated VV in FIG. 2 to provide steering movement and about a horizontal axis designated H in FIG. 6 to accommodate changes in elevation.

Figure 5:
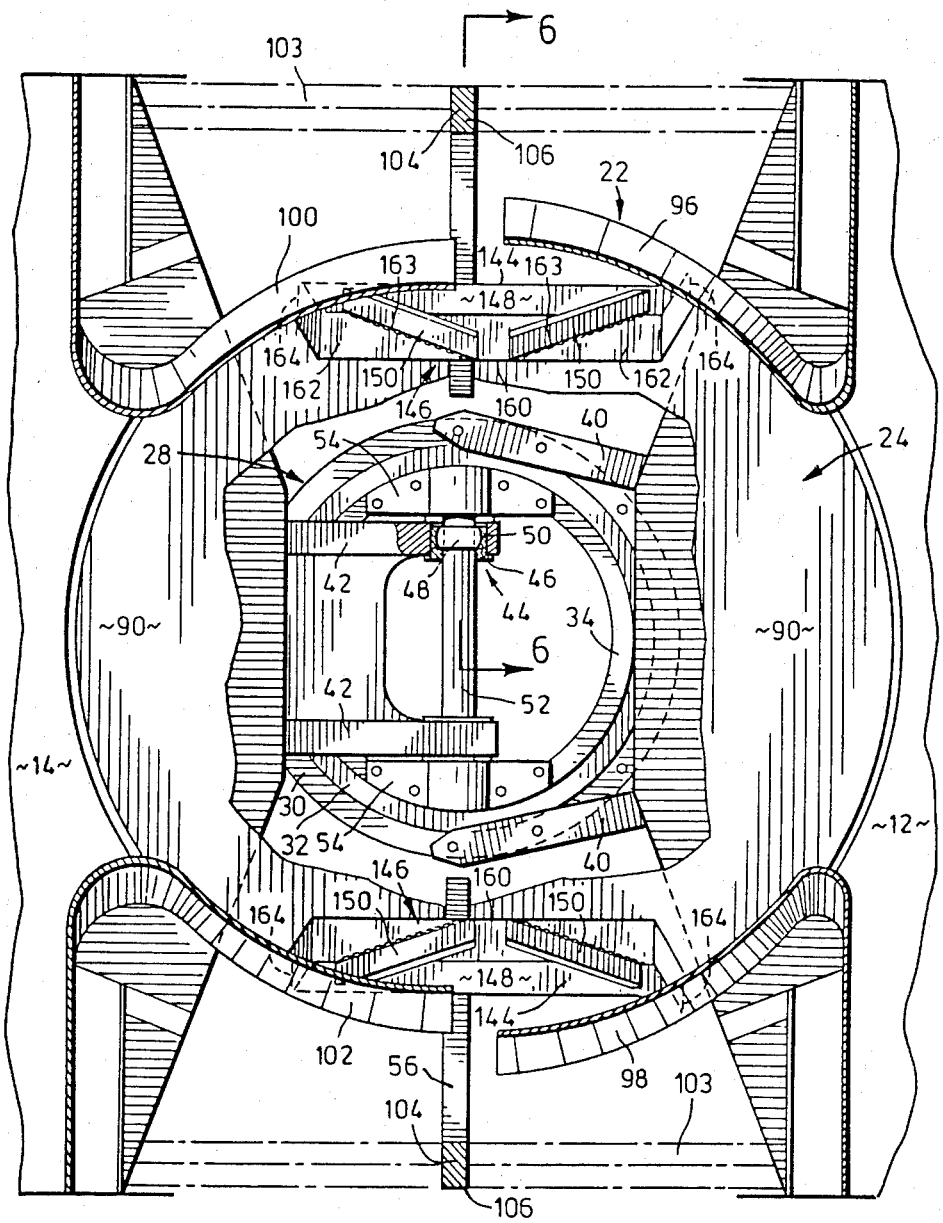
FIG. 5 is a section on the line 5—5 of FIG. 2.

The details of the turntable 24 and the connection of the curves 12, 14 thereto can best be seen in FIGS. 2 and 5. The turntable 24 comprises a transverse bolster 26 to which are rotatably mounted the wheel sets of the bogie 20. A bearing assembly 28 is also mounted on the bolster 26 and comprises an outer ring 30, intermediate ring 32 and an inner ring 34. A pair of races 36, 38 connect the outer and intermediate and the inner and intermediate rings respectively. The rings 30, 32 and 34 may therefore rotate relative to one another about a generally vertical axis.

The intermediate ring 32 is connected to the transverse bolster 26. The leading car 12 is provided with a pair of support beams 40 which project rearwardly from the car below the general level of the passenger carrying compartment and are bolted to the outer ring 30. The trailing car 18 also includes a pair of support beams 42 which project forwardly from the car in spaced parallel relationship. The ends of the support beams 42 are bored to receive self-aligning bearing assemblies 44 which comprise an outer race 46 and an inner race 48. Each of the races has a spherical bearing surface so that the inner race can adopt a wide range of positions relative to the outer race. The inner race 48 is bored as indicated at 50 to receive a transverse shaft 52. The ends of the shaft 52 are supported in upstanding ears 54 which are bolted to the inner ring 34 of the bearing assembly 28. The two cars 12, 14 may therefore rotate relative to one another about a generally vertical axis which will result in relative movement between the inner and outer rings. At the same time, the self-aligning bearing assemblies 44 permits the trailing car 14 to rotate about a generally horizontal axis relative to the leading car and intermediate bogie to accommodate vertical curves.

Figure 3:
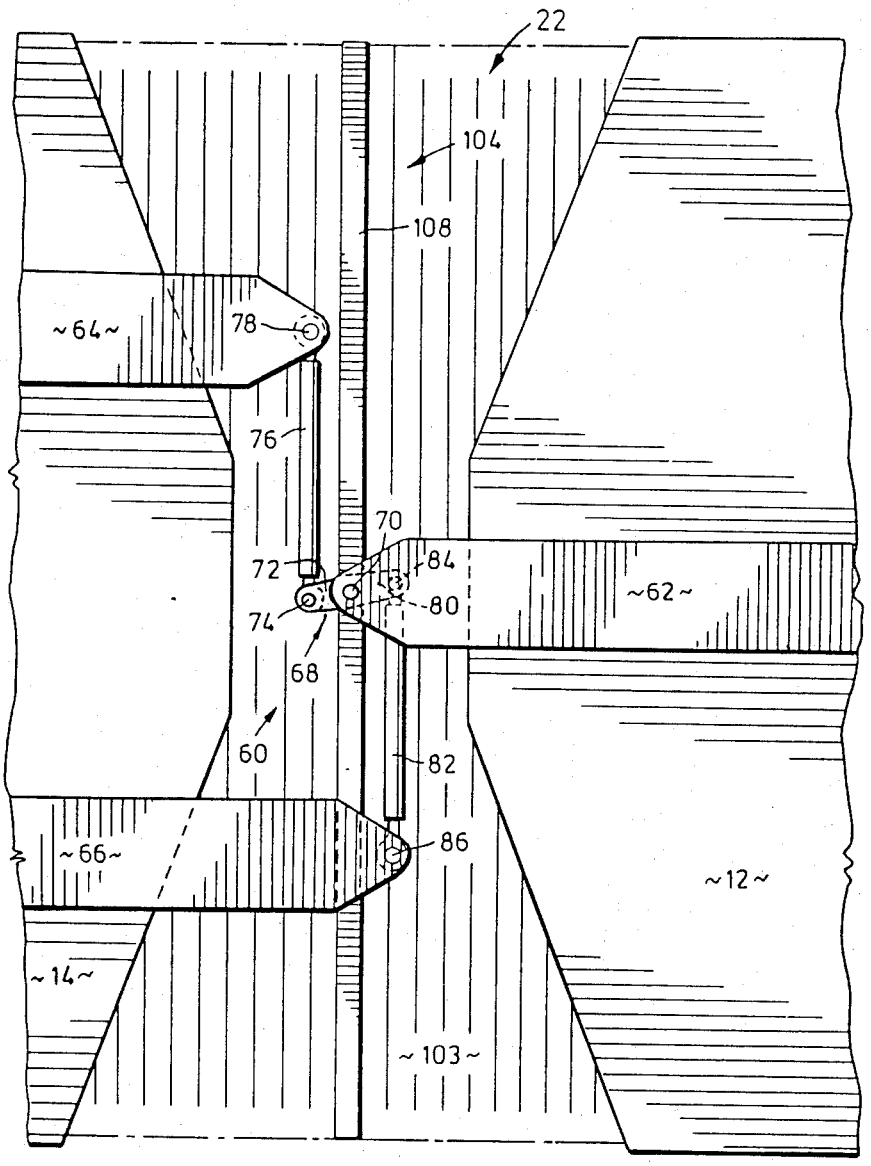

The cars 12, 14 are also connected at roof level by means of a torque resisting linkage generally designated 60. As can best be seen in FIG. 3, the leading car 12 includes a longitudinal beam 62 which projects rearwardly from the roof of the car 12 on the center line of the car. The trailing car 14 also includes a pair of longitudinal beams 64, 66 which are spaced to opposite sides of the center line of the car 14. The longitudinal beam 62 is pivotally connected to a cross-over link 68 by a pin 70 positioned midway along the link 68. One end 72 of the link 68 is pivotally connected by a connection 74 to a first transverse link 76. The link 76 is connected by a connection 78 to the beam 64. Similarly the other end 80 of the link 68 is connected by connection 84 to a second transverse link 82 which in turn is connected by a connection 86 to the beam 66. The first and second transverse links 76, 82 lie generally parallel to one another and the connections 74, 78, 84 and 86 are all arranged to permit pivoting movement about a generally vertical axis. The pin 70 is coincident with the vertical axis V of the turntable.

Figure 4A:
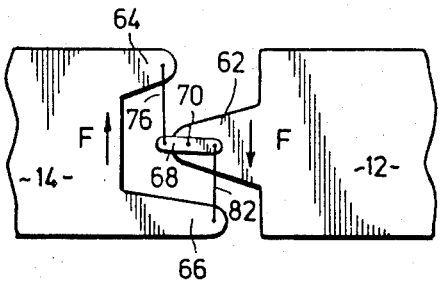
Figure 4B:
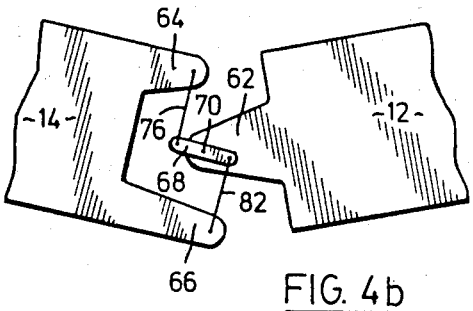
Figure 4C:
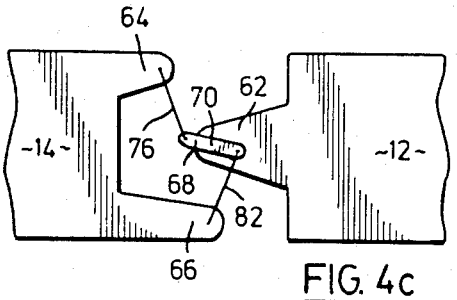

Upon the cars 12, 14 negotiating a horizontal curve, the cross over link 78 will rotate about the pin 70 to permit displacement of the cars 12, 14 about the vertical axis V. The orientation of the cross over link 68 with the transverse links 76, 82 remains constant so that a simple pivoting movement is achieved about the pin 70. This arrangement can best be seen in FIG. 4*b* in which the cars 12, 14 are negotiating a left hand curve. Upon the cars entering a vertical convex curve, the leading car will drop relative to the trailing car. This movement is accommodated about the transverse shaft 52 and causes a displacement in the position of the pin 70 relative to the rear car 14. This displacement is accommodated by pivotal movement of the transverse links relative to the support beams 64, 66 and by rotation of the cross over link 68 about the pin 70. Because the transverse links 76, 82 are substantially parallel and of equal length, the displacement of the connection 74 and 84 to either side of the center line of the vehicle is equal and opposite which is accommodated by rotation of the link 68 about the pin 70. This arrangement is shown in FIG. 4*c* in which it will be seen that the cross over link 68 is rotated in a clockwise direction about the pin 70 to allow the car 12 to rotate about the horizontal axis H relative to the trailing car 14. Thus the torque resistant linkage 60 does not inhibit the articulation of the cars about the horizontal and vertical axis.

Upon a force to cause lateral displacement between the cars 12, 14, due for example to an even track or to the banking of the track, the torque resistant linkage 60 operates to prevent relative displacement between the cars. The forces causing lateral displacement act to move the longitudinal beam 62 toward one of the beams 64, 66. This would cause the pin 70 to move toward the beam, for example 66, so that the second transverse link 82 would tend to induce rotation of the cross over link 68 about the pin 70 in an anti clockwise direction. However, such rotation is resisted by the first transverse link 76 acting on the opposite side of the pin 70 so that the forces tending to laterally displace the cars 12, 14 are resisted by the linkage 60. Such forces are also resisted by transverse shaft 52 operating through the bearing assembly 28 so that the cars remain aligned on the center line of the vehicle. The provision of the roof mounted torque resisting linkage 60 enables the bearing assembly 28 to be designed to accommodate much smaller forces than would otherwise be the case.

Figure 6:
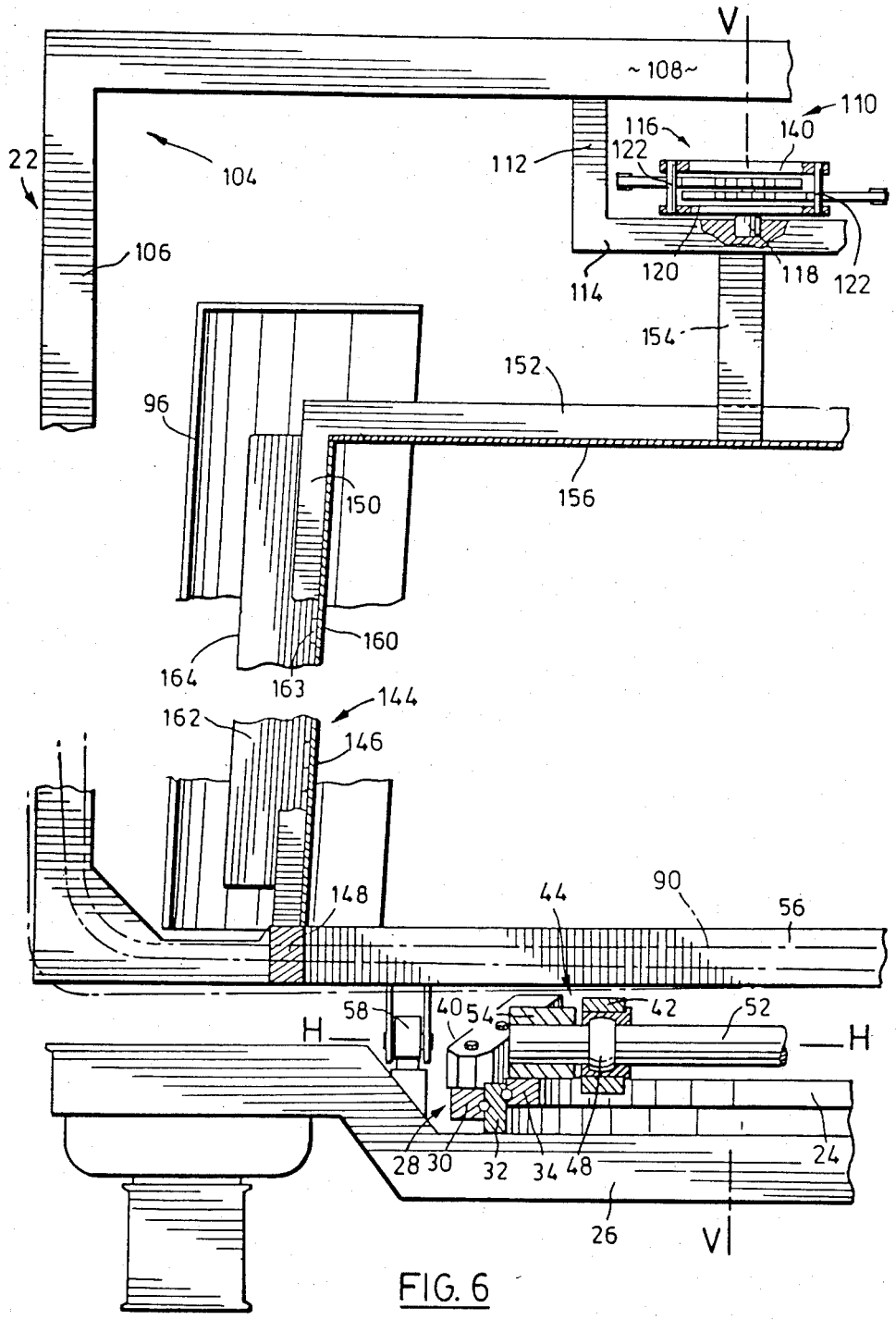
FIG. 6 is a section on the liner 6—6 of FIG. 5.

The tunnel structure 22 is supported on a transverse beam 56 which is connected by pins 58 to the outer ends of the bolster 26 as seen in FIG. 6. The pins 58 permit the beam to rotate about a generally horizontal axis to permit the tunnel structure to move back and forth along the longitudinal axis of the vehicle. The beam 56 also carries a pair of semi-circular floor plates 90 which are connected to the beam 56 by hinges 92. The periphery of the floor place rests on semi-circular recesses 94, 95 provided in the ends of the leading and trailing cars 12, 14 repsectively. Upon rotation of the cars about the vertical axis, sliding movement between the floor plates 90 and the respective recesses 94, 95 occurs and upon movement about the horizontal axis H, pivotal movement of the plates about the hinges 92 will occur. The periphery of the floor plates 90 is also covered by four part cylindrical shells or partitions 96, 98, 100, 102 which are connected in respective pairs to the leading and trailing cars 12, 14. The shells 96 to 102 define the entrance to the passageway between the cars and provide a smooth transition from the interior of the vehicle to the tunnel structure 22. It will be observed from FIG. 5 that the shells 96, 98 connected to the leading car 12 are of greater diameter than the shells 100, 102 connected to the trailing car 14. The shells are also inclined slightly to the vertical axis to provide a generally conical structure. The differing diameter of the shells permits them to overlap one another as the cars negotiate a horizontal curve.

The exterior of the cylindrical shells 96 to 102 is protected by a bellows 103 connected at opposite ends to the cars 12, 14 and supported intermediate the cars by a hoop 104. The hoop 104 is connected to the ends of the transverse beam 56 and includes a pair of vertical posts 106 and a horizontal beam 108. Depending from the horizontal beam is a hanger assembly 110 comprising a pair of vertical supports 112 and a cross beam 114. A centering mechanism generally designated 116 is pivoted on a shaft 118 to the cross beam for movement about a vertical axis.

The centering mechanism 116 is best seen in FIGS. 7 to 10 and comprises a base plate 120 rigidly connected to the shaft 118 for pivotal movement therewith. A pair of pivot pins 122 are mounted on the base plate 120 and each rotatably supports a pair of tooth levers 124, 126 respectively. Each of the levers 124, 126 comprises a circular head 128 having teeth 130 formed over a portion of the periphery of the head. A lever arm 132 is integrally formed with the head 128. The levers 124, 126 are arranged in pairs on each of the pivot pins 122 with the lever arms 132 extending in opposite directions on either side of the longitudinal axis of the vehicle. The spacing between the pins 122 is such that the teeth 130 of adjacent levers 124, 126 are meshed so that rotation of one of the levers about the pin 122 will induce equal and opposite rotation of the other lever about its pin 122. The extremities of each of the lever arms 132 are connected by vertical pivots 134 to struts 136. The struts 136 are connected to a mounting lug 137 on respective ends of the cars 12, 14 by a vertical pivot pin 138. A top plate 140 is mounted in spaced relationship from the base plate 120 and is secured to the base plate by pins 142.

Upon the cars 12, 14 rotating relative to one another about the horizontal axis H, the mounting lugs 137 will move either toward or away from each other to vary the distance between them. This movement is transmitted through the struts 136 and causes rotation of the respective two levers 124, 126 in opposite directions about the pins 122. Because the teeth 130 are in mesh, the equal and opposite rotation of the other pair of levers is induced which is only achieved if the cross beam 114 remains centered between the two lugs 137. Thus upon the cars 12, 14 negotiating a vertical curve, the centering mechanism 116 operates through the hanger assembly 110 to move the hoop 104 and the transverse beam 56 about the pins 58. In this way, the bellows remain centered between the two cars. Negotiation of a horizontal curve is accomplished by both of the links 124, 126 rotating about their respective pins 122 in the same sense, which is matched by equal and opposite displacement of the other pair of levers 124, 126. The centering mechanism therefore effectively rotates about the meshing teeth 130 to accommodate the horizontal curves.

A tunnel liner 144 is supported on the transverse beam 56 and by the hoop 104 to seal the area between the part cylindrical shells 96 to 102. The tunnel liner 144 includes a pair of side panels 146 which are connected to a pair of outriggers 148 mounted at opposite ends of the transverse beam 56. The side panels 146 are also supported by vertical posts 150 which converge to meet a horizontal roof truss 152. The roof truss 152 extends transversely across the tunnel liner 144 and is connected to a hanger 154 depending from the cross beam 114 of the hanger assembly 110. The side panels 146 are connected to a roof panel 156 which is also supported by the roof truss 152. The tunnel liner 144 therefore moves with the hoop 104 under the influence of the centering mechanism 116.

It will be noted that the tunnel structure 144 is displaced toward the leading car 12. This is to compensate for the different diameter of the shells 96, 98 and 100, 102 to equalise the spacing between side panels 146 and the adjacent shell.

It will be appreciated that as the street car 10 negotiates vertical curves, the side panels 146 and the cylindrical shells or partitions 96–102 will move relative to one another about the horizontal axis H. Under normal circumstances, such movement would cause the clearance between the panel 146 and the adjacent shell to vary along the height of the panel 146 due to the inclined line of contact of the panel 146 with the cylindrical surface of the shell. This has created a safety problem in that sufficient clearance must be left between the panels and the shells to allow for the maximum clearance which also results in a gap being left between the panels and the side walls to present a safety hazard. To overcome this problem, the side panels 146 are formed from a stationary portion 160 fixed to the outriggers 148 and to the roof panel 156. The stationary portion 160 is of a generally triangular shape with the base of a triangle supported by the outriggers 148 and with the apex adjacent the roof truss 152. A pair of triangular fillet panels 162 are hinged along the inclined edge 163 of the stationary portion so as to be pivotable about an axis running parallel to the inclined edge 163 of the stationary portion. The outer edges 164 of the fillet panels are jogged so as to lie at an acute angle with respect to the remainder of the side panels 146. The outer edges 164 are biased against the cylindrical shell or partitions 96 to 102 so as to follow the same during relative movement between the cars 12, 14.

Upon the car negotiating a horizontal curve, the cylindrical shells slide within one another at each side and the line of contact between the shells and the outer edges of the fillet panels 162 remains substantially vertical. However, upon the vehicle negotiating a convex vertical curve, the two cars rotate about the horizontal axis H which causes the upper edges of the cylindrical shells 96 to 102 to move away from each other. The movement of the upper edge of the shells is greater than that of the lower edge and due to the cylindrical nature of the shells 96 to 102, the distance between the top edge of each side panel 146 and its respective shell or partition will be greater than the distance between the lower edge of each side panel 146 and its respective shell or partition. However by hinging the fillet panels 162 along an inclined edge, for a given angular displacement of the fillet panel relative to the stationary portion 160, the upper edge of the fillet panel will move a greater distance laterally than the lower edge. This therefore compensates for the variation in lateral spacing and enables the fillet panels to closely follow the walls of the shells and maintain an effective seal at all times. This in fact is shown in FIG. 7*c* and the converse situation where the vehicle negotiates a concave vertical curve is shown in FIG. 7*b*. It has been found that by adopting the inclined hinged panels, the gap between the panels and the cylindrical shells can be effectively sealed at all times and therefore reduce the risk of entrapment of part of one of the passengers during movement of the vehicle.

We claim:

1. An articulated vehicle comprising a first chassis and a second chassis, each having an outboard and an inboard end, coupling means interconnecting said inboard ends and including vertical pivot means to accommodate relative movement of said chassis about a generally vertical axis for steering movement of said vehicle and horizontal pivot means to accommodate relative pivotal movement of said chassis about a generally transverse horizontal axis for relative vertical movement between said outboard ends, and a tunnel structure interconnecting said chassis, said tunnel structure including a first pair of laterally spaced upstanding partitions mounted on one of said chassis and defining a first passage, a second pair of laterally spaced upstanding partitions mounted on the other of said chassis and defining a second passage, a pair of upstanding side walls located inwardly of said partitions and each extending between said first and second passages to define a continuous passageway from said one chassis to the other, said side walls each including a stationary portion and a movable portion pivotally connected to said stationary portion for movement about an axis inclined to the axis defined by said vertical pivot means, said movable portions each having an edge abutting an adjacent partition, whereby upon movement of any partition relative to its associated side wall upon relative movement between said chassis about a horizontal axis, the associated movable portion moves about its respective inclined axis to follow the movement of the associated partition.

2. An articulated vehicle according to claim 1 wherein each of said side walls includes a pair of movable portions pivotally connected on opposite sides of said stationary portion of that side wall on upwardly converging axes.

3. An articulated vehicle according to claim 2 wherein each partition is curved to present a concave surface to the interior of said passages.

4. An articulated vehicle according to claim 3 wherein each of said movable portions includes a jog parallel to said one edge to present each of said one edges normal to their respective concave surfaces.

5. An articulated vehicle according to claim 3 wherein the radius of curvature of the concave surface of the partitions defining one of said passages is greater than the radius of curvature of the concave surface of the partitions defining the other of said passages to permit overlap of said passages during steering of said vehicle.

6. An articulated vehicle according to claim 5 wherein said concave surfaces are inclined toward the axis defined by said vertical pivot means.

7. An articulated vehicle according to claim 3 wherein each portion of said side walls is generally planar and said stationary portions are disposed parallel to one another and to the longitudinal axis of said vehicle.

8. An articulated vehicle according to claim 7 wherein said movable portions each include a jog generally parallel to said one edge to present said one edge normal to said concave surface.

9. An articulated vehicle according to claim 3 wherein said stationary portions are mounted on said vehicle for movement about a horizontal axis independent of said first and second chassis and a centering mechanism acts upon said stationary portions to maintain said stationary portions in a position to bisect the angle between said first and second chassis.

10. An articulated vehicle according to claim 9 wherein a bellows structure extends between said chassis externally of said tunnel structure.

11. An articulated vehicle according to claim 10 wherein said bellows structure includes a hoop to support flexible bellows and attached to said stationary portion for movement therewith.

* * * * *